US009903255B2

(12) United States Patent
Graf

(10) Patent No.: US 9,903,255 B2
(45) Date of Patent: Feb. 27, 2018

(54) COOLANT CIRCUIT FOR AN INTERNAL COMBUSTION ENGINE AND METHOD OF OPERATING A COOLANT CIRCUIT

(75) Inventor: Johann Graf, Hausen (DE)

(73) Assignee: Audi AG, Ingolstadt (DE)

( * ) Notice: Subject to any disclaimer, the term of this patent is extended or adjusted under 35 U.S.C. 154(b) by 513 days.

(21) Appl. No.: 14/235,688

(22) PCT Filed: Jun. 30, 2012

(86) PCT No.: PCT/EP2012/002784
§ 371 (c)(1),
(2), (4) Date: Jan. 28, 2014

(87) PCT Pub. No.: WO2013/017188
PCT Pub. Date: Feb. 7, 2013

(65) Prior Publication Data

US 2014/0182523 A1 Jul. 3, 2014

(30) Foreign Application Priority Data

Jul. 29, 2011 (DE) ..... 10 2011 108 953

(51) Int. Cl.
*F01P 7/14* (2006.01)
*F01P 7/16* (2006.01)

(52) U.S. Cl.
CPC ..... *F01P 7/14* (2013.01); *F01P 7/162* (2013.01); *F01P 2007/146* (2013.01); *F01P 2037/02* (2013.01)

(58) Field of Classification Search
CPC ..... F01P 2037/02; F01P 3/20; F02D 41/0055; F02D 41/068; F02M 25/0731
(Continued)

(56) References Cited

U.S. PATENT DOCUMENTS 5,558,055 A * 9/1996 Schatz ..... B60H 1/00492 123/142.5 R
6,343,572 B1 2/2002 Pfaff et al.
(Continued)

FOREIGN PATENT DOCUMENTS

DE 100 45 613 4/2002
DE 101 54 091 5/2003
(Continued)

OTHER PUBLICATIONS

International Search Report issued by the European Patent Office in International Application PCT/EP2012/002784 dated Oct. 5, 2012.

*Primary Examiner* — Long T Tran
(74) *Attorney, Agent, or Firm* — Henry M. Feiereisen LLC

(57) ABSTRACT

The invention relates to a coolant circuit (1) for an internal combustion engine (2), wherein the coolant can circulate between the internal combustion engine (2) and a heat sink (3) depending upon a switchable valve (4), which is closed in the initial state during a cold start of the internal combustion engine (2), wherein the valve (4) can be switched to an at least partially opened sequential state depending on an exhaust gas mass flow emitted by the internal combustion engine (2), and wherein a control device (6) determines an integral of the exhaust gas mass flow with respect to the time and switches the valve (4) into the sequential state when an integral threshold value is exceeded.

5 Claims, 1 Drawing Sheet

(58) Field of Classification Search
USPC ..... 123/41.01, 41.02, 41.14, 41.52, 41.05, 123/41.44
See application file for complete search history.

(56) References Cited

U.S. PATENT DOCUMENTS

| | | | | |
|---|---|---|---|---|
| 6,789,512 | B2 * | 9/2004 | Duvinage | B60H 1/02 123/41.05 |
| 7,353,865 | B2 | 4/2008 | Speer | |
| 8,046,150 | B2 | 10/2011 | Anilovich et al. | |
| 8,170,779 | B2 * | 5/2012 | Iwase | F01N 5/02 123/142.5 R |
| 2003/0089319 | A1 * | 5/2003 | Duvinage | B60H 1/02 123/41.02 |
| 2004/0200198 | A1 | 10/2004 | Inoue et al. | |
| 2006/0005790 | A1 * | 1/2006 | Braun | F01P 7/167 123/41.08 |

FOREIGN PATENT DOCUMENTS

| | | |
|---|---|---|
| DE | 602004004016 | 8/2007 |
| DE | 102009054359 | 7/2010 |
| EP | 1 529 936 | 5/2005 |
| WO | WO 99/01650 | 1/1999 |

* cited by examiner

COOLANT CIRCUIT FOR AN INTERNAL COMBUSTION ENGINE AND METHOD OF OPERATING A COOLANT CIRCUIT

CROSS-REFERENCES TO RELATED APPLICATIONS

This application is the U.S. National Stage of International Application No. PCT/EP2012/002784, filed Jun. 30, 2012, which designated the United States and has been published as International Publication No. WO 2013/017188 and which claims the priority of German Patent Application, Serial No. 10 2011 108 953.9, filed Jul. 29, 2011, pursuant to 35 U.S.C. 119(a)-(d).

BACKGROUND OF THE INVENTION

The invention relates to a coolant circuit for an internal combustion engine, wherein the coolant can circulate between the internal combustion engine and a heat sink as a function of a switchable valve which is closed in the initial state during a cold start of the internal combustion engine, and to a method of operating a coolant circuit.

Such coolant circuits are used in particular in the automotive industry to cool coolant, heated by the internal combustion engine, through circulation via the heat sink. In this way, the internal combustion engine is protected from damage due to overheating. To reduce friction work of the internal combustion engine in terms of improved efficiency, a rapid heating of the internal combustion engine and thus also of the coolant is desirable, when the internal combustion engine is at a cold start. For this reason, a valve switched to a closed state can prevent a coolant circulation until a sufficient heating has been reached.

The determination of the point in time for opening the valve is realized in the art in dependence on when the internal combustion engine exceeds a torque or rotation speed threshold. DE 100 45 613 A1 discloses a method for controlling the coolant temperature of an engine cooling system, with the coolant temperature being controlled in dependence on a load and/or rotation speed of the internal combustion engine. This oftentimes leads to premature opening of the valve, when the coolant temperatures are too low so that efficiency losses have to be accepted.

DE 101 54 091 A1 describes a method and a device for controlling a cooling system of an internal combustion engine, with the capacity of a coolant pump being controllable as a function of a fuel quantity fed to the internal combustion engine. However, the fuel quality is not readily useful as a control variable for controlling a cooling system because of the absence of a stoichiometric conversion of the fuel, in particular during a cold start of the internal combustion engine.

SUMMARY OF THE INVENTION

It is therefore an object of the present invention to provide a coolant circuit for an internal combustion engine, and a method of operating a coolant circuit that enables an efficiency which is optimized for a cold start of the internal combustion engine.

According to one aspect of the invention, the object is achieved by a coolant circuit for an internal combustion engine, wherein the coolant is able to circulate between the internal combustion engine and a heat sink as a function of a switchable valve which is closed in the initial state during a cold start of the internal combustion engine, and wherein the valve is switchable into an at least partly open sequential state in response to an exhaust gas mass flow emitted from the internal combustion engine, with a control device determining an integral of the exhaust gas mass flow with respect to time and switching the valve to the sequential state when an integral threshold value is exceeded.

By making the opening of the valve after a cold start dependent on the emitted exhaust gas mass flow, the optimal point in time to terminate the rapid heating of the internal combustion engine can be very precisely determined. The integral value of the exhaust gas mass flow with respect to the time reflects the actual input of heat energy into the coolant. When the integral value exceeds a predefined integral threshold value, the valve is opened fully or incrementally. As a result, local overheating of the internal combustion engine (so-called "hot spots") are effectively prevented on the one hand, and low friction work is reached as fast as possible on the other hand. A cold start can be understood in this context as a start-up of the internal combustion engine in which the coolant temperature approximately corresponds to the temperature of ambient air. A heat sink may be realized by a typical air-liquid heat exchanger which forms a circulation via a tube connection to the internal combustion engine. For forced circulation of coolant, coolant pumps, such as centrifugal pumps, are suitable. The valve is preferably configured as a heatable map-controlled thermostat or actuated by pneumatic or electric mechanics.

According to a preferred configuration of the coolant circuit, the control device determines the exhaust gas mass flow on the basis of an injection amount of a fuel. The control device is preferably designed hereby as a control unit for the internal combustion engine and measures in this function, inter alia, the amount of fuel to be injected. The exhaust gas mass flow being emitted after combustion and discharged through the exhaust system derives necessarily from the amount of fuel.

According to a preferred embodiment of the coolant circuit, the control device determines the injection amount per unit of time. Particularly advantageous is the subdivision of the injection operation into smallest possible units of time to more accurately determine the injection amount.

According to a preferred embodiment of the coolant circuit, the valve is part of a coolant pump or is formed by the coolant pump. The valve can be integrated into the coolant pump or formed by a switchable coolant pump. As a result, components and installation space can be saved.

According to another aspect of the invention, the object is achieved by a method of operating a coolant circuit for an internal combustion engine, wherein the coolant can circulate between the internal combustion engine and a heat sink as a function of a switchable valve, the method including the following steps:

- switching to a closed initial state of the valve during a cold start of the internal combustion engine;
- continuously ascertaining an exhaust gas mass flow emitted by the internal combustion engine as of a cold start;
- switching the valve into an at least partially open sequential state in dependence on the exhaust gas mass flow, with an integral of the exhaust gas mass flow being formed according to the time, and the sequential state being switched to when an integral threshold value is exceeded.

When carrying out the method according to the invention, the same advantages are attained as already mentioned for the coolant circuit.

BRIEF DESCRIPTION OF THE DRAWING

Further details and features of the invention will become apparent from the following description of a preferred exemplary embodiment with reference to the drawings.

It is shown in the drawings.

DETAILED DESCRIPTION OF PREFERRED EMBODIMENTS

Figure 1:
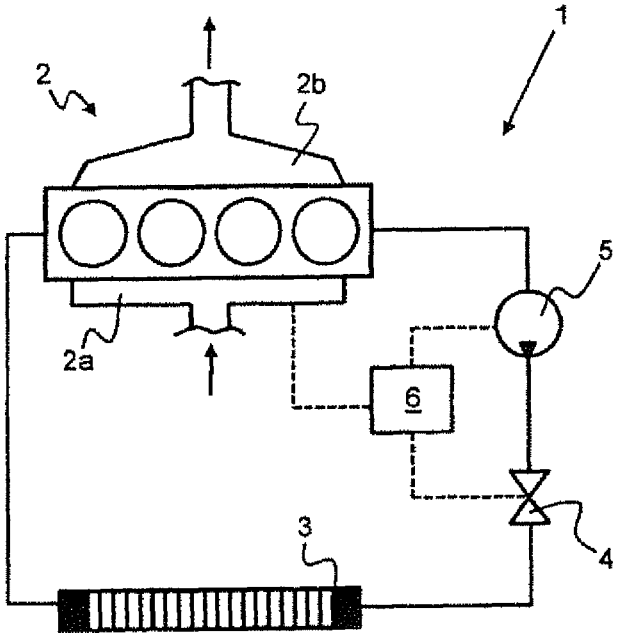
FIG. 1 a schematic view of a coolant circuit for an internal combustion engine.
Figure 2:
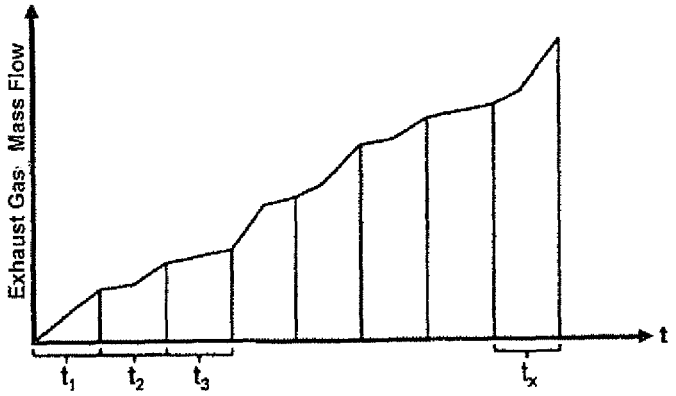
FIG. 2 is a diagrammatic illustration of the exhaust gas mass flow over time.

According to FIG. 1, a coolant circuit 1 for an internal combustion engine 2 has a heat sink 3. The heat sink 3 is circulated by ambient air on one hand, and coolant on the other hand. As a result of the realized heat exchange, coolant circulating in the coolant circuit 1 cools down. The coolant circulation is implemented by a coolant pump 5, with a switchable valve 4 being able to stop the coolant circulation. The internal combustion engine 2 has multiple combustion chambers 2*c* in which fuel is combusted so that the internal combustion engine 2 is heated. The generated heat can be dissipated by the coolant to the heat sink 3. The fuel is injected either into the intake system 2*a* or directly into the combustion chambers 2*c* and then mixed with intake air. Spent fuel-air mixture is expelled through the exhaust system 2*b*. A control device 6 ascertains the amount of injection of fuel per unit of time and determines the exhaust gas mass flow through the exhaust system 2*b*. The control device 6 forms an integral of the exhaust gas mass flow over time, as shown in FIG. 2. During a cold start of the internal combustion engine 2, that is, at the start at a coolant temperature which approximately corresponds to the ambient temperature, the valve 4 is in its closed starting condition and there is no coolant circulation. The control device 6 begins at the same time with a continuous computation of the integral value and causes the valve 4 to at least open in part as soon as the integral value exceeds a defined integral threshold value.

According to the FIG. 2, the integral value is formed in that the emitted exhaust gas mass flow per unit of time $t_x$ is ascertained and integrated until the integral threshold value is exceeded.

What is claimed is:

1. An arrangement, comprising:

a coolant circuit for an internal combustion engine;

a heat sink disposed in the coolant circuit;

a valve disposed in the coolant circuit, said valve being configured to assume a closed state to bar a circulation of coolant between the internal combustion engine and the heat sink during a cold start of the internal combustion engine, and an open state allowing the circulation of coolant; and a control device configured to determine an integral of an exhaust gas mass flow emitted by the internal combustion engine with respect to time and to switch the valve to an at least partially open state disposed between the closed state and the open state, when the integral exceeds a threshold value.

2. The arrangement of claim 1, wherein the control device is configured to determine the exhaust gas mass flow from an injection amount of a fuel.

3. The arrangement of claim 2, wherein the control device is configured to determine the injection amount per unit of time.

4. The arrangement of claim 1, wherein the valve is part of a coolant pump or is formed by a coolant pump.

5. A method of operating a coolant circuit for an internal combustion engine, comprising:

switching a valve to a closed initial state during a cold start of the internal combustion engine to prevent circulation of coolant between the internal combustion engine and a heat sink;

continuously determining values of an exhaust gas mass flow emitted by the internal combustion engine beginning from the cold start of the internal combustion engine;

forming an integral of the determined values with respect to time; and switching the valve to an at least partially open state disposed between the closed state and an open state, allowing the circulation, when the integral exceeds a threshold value.

* * * * *